US010582315B2

(12) United States Patent
Hiruma et al.

(10) Patent No.: US 10,582,315 B2
(45) Date of Patent: Mar. 3, 2020

(54) FEEDBACK CANCELLER AND HEARING AID

(71) Applicant: RION Co., Ltd., Kokubunji-shi, Tokyo (JP)

(72) Inventors: Nobuhiko Hiruma, Kokubunji (JP); Masahiro Sunohara, Kokubunji (JP)

(73) Assignee: RION Co., Ltd., Tokyo (JP)

( * ) Notice: Subject to any disclaimer, the term of this patent is extended or adjusted under 35 U.S.C. 154(b) by 0 days.

(21) Appl. No.: 16/035,903

(22) Filed: Jul. 16, 2018

(65) Prior Publication Data

US 2019/0028818 A1 Jan. 24, 2019

(30) Foreign Application Priority Data

Jul. 18, 2017 (JP) ..... 2017-139497

(51) Int. Cl.
*H04R 25/00* (2006.01)
*H04R 3/02* (2006.01)

(52) U.S. Cl.
CPC ..... *H04R 25/453* (2013.01); *H04R 3/02* (2013.01); *H04R 25/505* (2013.01); *H04R 2225/41* (2013.01)

(58) Field of Classification Search
CPC ..... H04R 2225/43; H04R 25/505; H04R 2460/01
USPC ..... 381/318, 317; 379/406.03, 406.04
See application file for complete search history.

(56) References Cited

U.S. PATENT DOCUMENTS 7,933,424 B2 * 4/2011 Klinkby ..... H04R 25/453 381/317
2003/0081762 A1 * 5/2003 Zad Issa ..... H04M 9/082 379/406.01
2006/0291681 A1 12/2006 Klinkby et al.
2012/0320471 A1 * 12/2012 Supino ..... G11B 5/5582 360/75
2016/0180858 A1 * 6/2016 Breebaart ..... G10L 19/008 704/504

FOREIGN PATENT DOCUMENTS

JP 2007525917 A 9/2007

* cited by examiner

*Primary Examiner* — Alexander Krzystan
(74) *Attorney, Agent, or Firm* — Rankin, Hill & Clark LLP

(57) ABSTRACT

Provided is a hearing aid including a receiver, a microphone, an adaptive filter estimating a feedback transfer function from the receiver to the microphone, a subtractor, a hearing aid processor, a first whitening filter, a second whitening filter having a whitening filter coefficient identical to that of the first whitening filter, a coefficient updater, and a controller controlling the adaptive filter and the first and second whitening filters. The controller updates and saves, as a stabilization coefficient, the coefficient of the adaptive filter in a condition in which the autocorrelation of the first signal is low, determines the presence or absence of a change in the feedback transfer function based on the coefficient of the adaptive filter and the stabilization coefficient, and performs, when it is determined that the feedback transfer function has changed, the control in order that effectiveness of whitening by the first and second whitening filters is reduced as compared to that when it is determined that the feedback transfer function does not change.

10 Claims, 9 Drawing Sheets

ADAPTIVE LATTICE FILTER

FEEDBACK CANCELLER AND HEARING AID

CROSS-REFERENCE TO RELATED APPLICATION

This application claims priority from Japanese Patent Application No. 2017-139497 filed with the Japan Patent Office on Jul. 18, 2017, the entire contents of which are hereby incorporated by reference.

BACKGROUND

1. Technical Field

This disclosure relates to a feedback canceller and a hearing aid.

2. Related Art

A typical hearing aid includes a microphone configured to collect sound transmitted from an external space, and a receiver configured to output sound to a user's external ear canal. Upon use of the hearing aid, the sound output from the receiver might leak to the external space from the external ear canal, and might be fed back to the microphone. In this condition, acoustic feedback might occur. A feedback canceller with using an adaptive filter configured to adaptively estimate a feedback transfer function has been broadly known as a device configured to reduce occurrence of such acoustic feedback. The feedback canceller of this type is effective for reducing occurrence of typical acoustic feedback. However, when a periodic signal is input, there are possibilities that failure of adaptive operation is caused. That is, in a case where the signal input to the adaptive filter exhibits periodicity close to a sine wave (an autocorrelation is high), so-called entrainment occurs. For this reason, a phenomenon has been known, in which noise occurs due to distortion of the input signal. For example, a configuration in which a whitening filter (a frequency equalization unit) is inserted into an input side of the adaptive filter to whiten the input signal (lower the autocorrelation) has been proposed as measures against entrainment (see, e.g., JP-T-2007-525917).

SUMMARY

The hearing aid of this disclosure includes a receiver configured to convert an electric signal into sound; a microphone configured to convert sound into an electric signal; an adaptive filter configured to adaptively estimate a feedback transfer function from the receiver to the microphone; a subtractor configured to subtract an output signal of the adaptive filter from an output signal of the microphone, thereby generating a first signal; a hearing aid processor configured to perform predetermined hearing aid processing for the first signal, thereby generating a second signal to be input to the receiver; a first whitening filter configured to whiten the first signal; a second whitening filter having a whitening filter coefficient identical to that of the first whitening filter and configured to whiten the second signal; a coefficient updater configured to update the coefficient of the adaptive filter based on each of output signals of the first and second whitening filters; and a controller configured to perform control of operation of the adaptive filter and the first and second whitening filters. The controller updates and saves, as a stabilization coefficient, the coefficient of the adaptive filter in a condition in which the autocorrelation of the first signal is low, determines the presence or absence of a change in the feedback transfer function based on the coefficient of the adaptive filter and the stabilization coefficient, and performs, when it is determined that the feedback transfer function has changed, the control in order that effectiveness of whitening by the first and second whitening filters is reduced as compared to that when it is determined that the feedback transfer function does not change.

DETAILED DESCRIPTION

Figure 1:
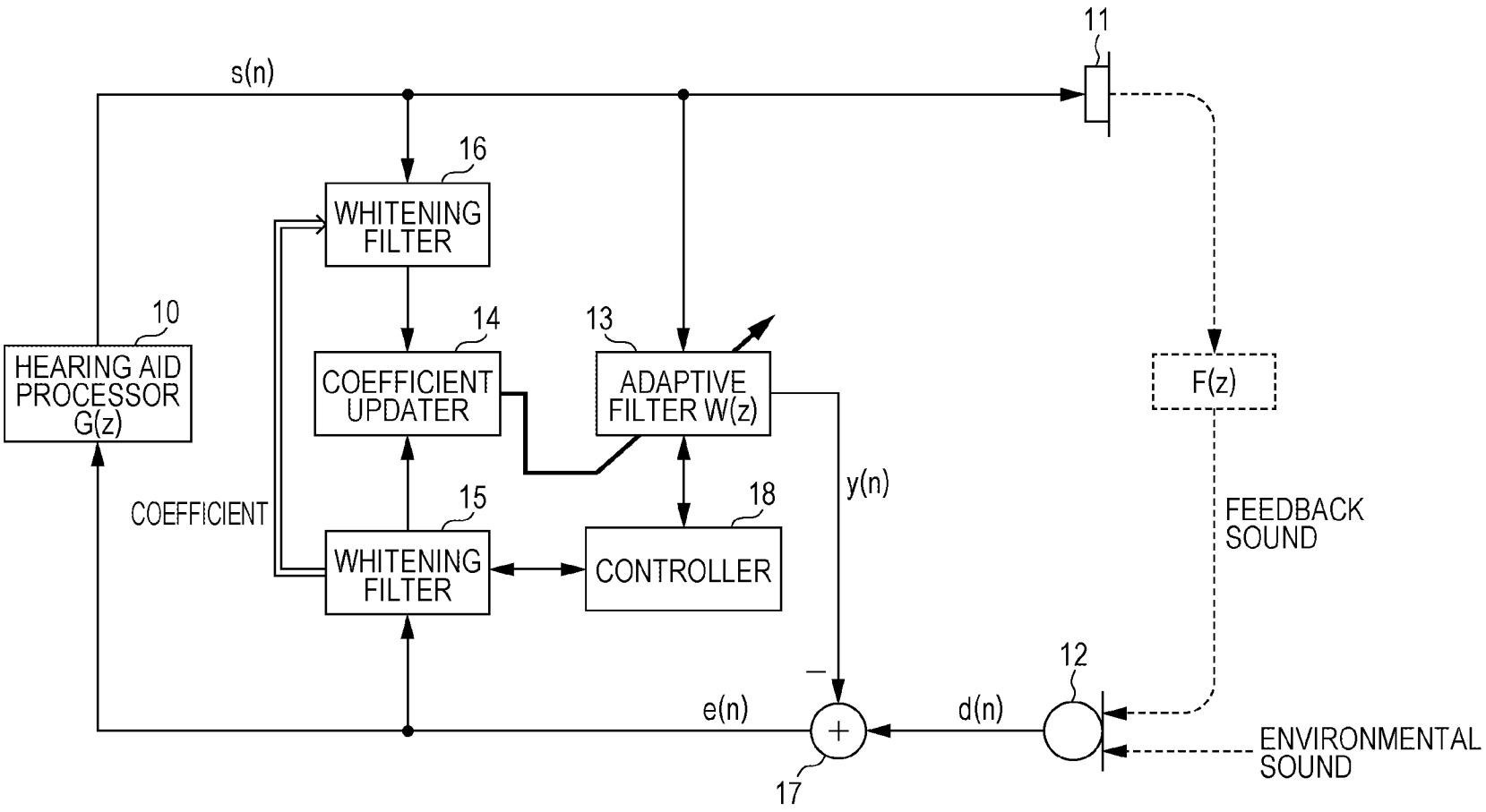
FIG. 1 is a block diagram of a specific configuration example relating to digital signal processing in a hearing aid of this embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

By whitening the input signal with using the above-described whitening filter, occurrence of entrainment (the noise) in the feedback canceller can be reduced. However, an acoustic feedback signal is whitened by the whitening filter, assuming that the acoustic feedback occurs in the feedback canceller. Thus, suppression of the acoustic feedback in the feedback canceller is insufficient, leading to a problem that an acoustic feedback suppression time is extended. Note that in the case of applying, as the measures against entrainment, a frequency shift method without using the whitening filter, lowering of sound quality is inevitable.

The hearing aid of this disclosure has been developed to solve these problems. That is, this disclosure provides a hearing aid etc. configured in order that occurrence of noise due to entrainment is reduced by a simple configuration with using whitening filters while acoustic feedback is effectively suppressed within a short acoustic feedback suppression time.

For solving the above-described problems, the hearing aid of this disclosure includes a receiver (11) configured to convert an electric signal into sound; a microphone (12) configured to convert sound into an electric signal; an adaptive filter (13) configured to adaptively estimate a feedback transfer function (F(z)) from the receiver to the microphone; a subtractor (17) configured to subtract an output signal of the adaptive filter from an output signal of the microphone, thereby generating a first signal (e(n)); a hearing aid processor (10) configured to perform predetermined hearing aid processing for the first signal, thereby generating a second signal (s(n)) to be input to the receiver; a first whitening filter (15) configured to whiten the first signal; a second whitening filter (16) having a whitening filter coefficient (γ(n)) identical to that of the first whitening filter and configured to whiten the second signal; a coefficient updater (14) configured to update the coefficient (W(n)) of the adaptive filter based on each of output signals of the first and second whitening filters; and a controller (18) configured to perform control of operation of the adaptive filter and the first and second whitening filters. The controller updates and saves, as a stabilization coefficient (Ws(n)), the coefficient of the adaptive filter in a condition in which the autocorrelation of the first signal is low, determines the presence or absence of a change in the feedback transfer function based on the coefficient of the adaptive filter and the stabilization coefficient, and performs, when it is determined that the feedback transfer function has changed, the control in order that effectiveness of whitening by the first and second whitening filters is reduced as compared to that when it is determined that the feedback transfer function does not change.

According to the hearing aid of this disclosure, the controller configured to control operation of the first and second whitening filters updates and saves, as the stabilization coefficient, the coefficient of the adaptive filter when the input first signal is in a stable condition. Thereafter, based on the obtained coefficient of the adaptive filter and the saved stabilization coefficient, the controller determines a change in the feedback transfer function, and according to such a determination result, can properly control the effectiveness of whitening by each whitening filter. Thus, in a situation where no acoustic feedback occurs, occurrence of entrainment can be reduced by operation of the whitening filters. In addition, in a situation where the acoustic feedback occurs, the effectiveness of whitening can be controlled in order that operation of the whitening filters do not provide an adverse effect to adaptive operation of the adaptive filter. At this point, a change in the feedback transfer function is determined with using the stabilization coefficient updated in a low autocorrelation condition. Thus, erroneous determination in a condition in which a signal with a high autocorrelation has been input can be avoided. With the above-described configuration, both of reduction in entrainment causing the problems in the hearing aid and prompt and reliable acoustic feedback suppression can be realized.

The controller of this embodiment, for example, calculates the average (ψ(n)) of the whitening filter coefficients, and compares a preset first threshold (T1) and the average. When it is determined that the average is smaller, the controller can perform the control to update the stabilization coefficient. At this point, in a condition in which the signal with the high autocorrelation is input to the whitening filters, the average of the whitening filter coefficient inevitably increases, and therefore, the above-described determination conditions are not satisfied. For this reason, the stabilization coefficient in the low autocorrelation condition can be obtained by the above-described control.

For example, an adaptive lattice filter with a predetermined number of stages can be used as the whitening filter of this embodiment. The whitening filter coefficient in this case is the reflection coefficient of the adaptive lattice filter. The adaptive lattice filter is effective in terms of increasing a convergence velocity as compared to other whitening filters.

One example of the control by the controller of this embodiment includes the control performed in order that the effectiveness of whitening is at a predetermined level when it is determined that the feedback transfer function does not change and performed in order that the effectiveness of whitening is lower than the predetermined level when it is determined that the feedback transfer function has changed. In this case, various levels of the effectiveness of whitening and various numbers of stages can be set according to actual environment. Other examples of the control by the controller used in this embodiment include the control to actuate (ON) the whitening filters when it is determined that the feedback transfer function does not change and to stop operation (OFF) of the whitening filters when it is determined that the feedback transfer function has changed.

For example, the controller of this embodiment calculates the sum (D(n)) of a difference between the coefficient of the adaptive filter and the stabilization coefficient, and compares a preset second threshold (T2) with the difference sum D(n). According to a comparison result, the controller can perform the control to determine the presence or absence of a change in the feedback transfer function. When the coefficient of the adaptive filter temporarily changes due to occurrence of the acoustic feedback, the stabilization coefficient difference increases. Thus, the above-described control can easily determine that the feedback transfer function has changed.

When determining that the feedback transfer function has changed, the controller of this embodiment can perform the control to increase the convergence velocity of the adaptive filter in addition to the control to reduce the effectiveness of whitening by the whitening filters. This allows convergence of the adaptive filter within a short period of time in a situation where the acoustic feedback occurs. Note that for increasing the convergence velocity of the adaptive filter, the step size of the adaptive filter may be increased, for example.

Moreover, for solving the above-described problems, a feedback canceller of this disclosure includes a first conversion device configured to convert an electric signal into sound; a second conversion device configured to convert sound into an electric signal; an adaptive filter configured to adaptively estimate a feedback transfer function from the first conversion device to the second conversion device; a subtractor configured to subtract an output signal of the adaptive filter from an output signal of the second conversion device, thereby generating a first signal; a signal processor configured to perform predetermined signal processing for the first signal, thereby generating a second signal to be input to the first conversion device; a coefficient updater configured to update the coefficient of the adaptive filter; and a controller configured to perform at least control of operation of the adaptive filter. The controller updates and saves, as a stabilization coefficient, the coefficient of the adaptive filter in a condition in which the autocorrelation of the first signal is low, and determines the presence or absence of a change in the feedback transfer function based on the coefficient of the adaptive filter and the stabilization coefficient.

According to the feedback canceller of this disclosure, the presence or absence of a change in the feedback transfer function due to, e.g., occurrence of the acoustic feedback can be determined based on the coefficient of the adaptive filter and the updated and saved stabilization coefficient. Thus, various types of control can be executed according to a determination result.

The feedback canceller of this disclosure may further include a first whitening filter configured to whiten the first signal, and a second whitening filter having a whitening filter coefficient identical to that of the first whitening filter and configured to whiten the second signal. The coefficient updater may update the coefficient of the adaptive filter based on each of output signals of the first and second whitening filters. When the feedback transfer function has changed, the controller may perform the control in order that effectiveness of whitening by the first and second whitening filters is reduced as compared to that when the feedback transfer function does not change. With this configuration, the feedback canceller providing advantageous effects similar to those of the above-described hearing aid is, for example, applicable to a variety of equipment and systems such as an echo canceller (a conferencing system).

As described above, the hearing aid is configured to include the feedback canceller of this disclosure can reduce occurrence of noise due to entrainment with using the whitening filters, and can properly control operation of the whitening filters according to the presence or absence of a change in the feedback transfer function. With this configuration, influence of the whitening filters on the adaptive operation of the adaptive filter can be reduced, and the acoustic feedback can be reliably suppressed within a short acoustic feedback suppression time. Moreover, the feedback canceller of this disclosure can realize, with better sound quality, both of measures against entrainment and acoustic feedback suppression as compared to the case of applying a frequency shift method as the measures against entrainment, for example.

Hereinafter, this embodiment will be described with reference to the attached drawings. In this embodiment, an example of a hearing aid of a feedback canceller of this disclosure will be described.

FIG. 1 is a block diagram of a specific configuration example relating to digital signal processing in the hearing aid of this embodiment. The configuration example of FIG. 1 illustrates a hearing aid processor 10, a receiver 11, a microphone 12, an adaptive filter 13, a coefficient updater 14, two whitening filters 15, 16, a subtractor 17, and a controller 18. Of these components, other components than the receiver 11 and the microphone 12 can be, for example, implemented by signal processing by a digital signal processor (DSP) configured to execute digital signal processing. Each component of FIG. 1 is operated by power supplied from a battery (not shown) set to the inside of the hearing aid. Note that although not shown in the figure, a DA converter configured to convert a digital signal into an analog signal is provided on an input side of the receiver 11. Further, an AD converter configured to convert an analog signal into a digital signal is provided on an output side of the microphone 12.

In the above-described configuration, the hearing aid processor 10 is configured to amplify an error signal e(n) output from the subtractor 17. In addition, the hearing aid processor 10 is configured to perform predetermined hearing aid processing set separately to fit each user, thereby outputting a signal s(n) subjected to the hearing aid processing. The hearing aid processing by the hearing aid processor 10 is represented by a transfer function G(z) illustrated in FIG. 1. Examples of the hearing aid processing applicable by the hearing aid processor 10 include a variety of processing according to hearing characteristics of the hearing aid user and use environment, such as addition of a predetermined gain to the error signal e(n) and multiband compression, noise reduction, tone control, and output limiting process for the error signal e(n).

Note that the error signal e(n) input to the hearing aid processor 10 corresponds to a first signal of this embodiment, and the signal s(n) output from the hearing aid processor 10 corresponds to a second signal of this embodiment.

The receiver 11 is, for example, located in the external ear canal of the user, and is configured to convert the signal s(n) output from the hearing aid processor 10 into sound to output the sound to a space in the external ear canal. For example, an electromagnetic receiver can be used as the receiver 11. Moreover, the microphone 12 is configured to collect sound transmitted from an external space of the hearing aid, thereby converting the sound into an electric signal. This electric signal is, as a desired signal d(n), output from the microphone 12. Micro Electro Mechanical Systems (MEMS) or a condenser microphone can be used as the microphone 12.

In FIG. 1, only external environmental sound is ideally input to the microphone 12. Note that the sound output from the receiver 11 is, in fact, picked up from the external ear canal by the microphone 12 via the external space, and turns to feedback sound. At this point, a feedback transfer function F(z) in a feedback path from the input of the receiver 11 to the output of the microphone 12 can be assumed. Note that the receiver 11 and the microphone 12 each have unique transfer functions. It can be considered that any of these transfer functions is included in the feedback transfer function F(z). The feedback transfer function F(z) changes, for example, according to a hearing aid structure, behavior of the user (e.g., a case where the hand of the user approaches the hearing aid), or surrounding environment (e.g., in an automobile). A change in the feedback transfer function F(z) is a cause for acoustic feedback of the hearing aid. As will be described later, the hearing aid of this embodiment has, for reducing occurrence of such acoustic feedback, such a configuration that the feedback transfer function F(z) is estimated to cancel a feedback component. Details of such a configuration will be described later.

The adaptive filter 13 is configured to adaptively estimate a transfer function W(z) corresponding to the feedback transfer function F(z) for the signal s(n) subjected to the hearing aid processing, with using a coefficient W(n) supplied from the coefficient updater 14, thereby generating an output signal y(n). Note that the subtractor 17 is configured to subtract the output signal y(n) of the adaptive filter 13 from the desired signal d(n). A signal obtained by subtraction is, by the subtractor 17, output as the error signal e(n). Moreover, the coefficient updater 14 is configured to sequentially update the coefficient W(n) used for data processing in the adaptive filter 13. For example, a finite impulse response (FIR) with a predetermined number of taps (e.g., 32 taps) can be used as the adaptive filter 13. The coefficient updater 14 can employ a variety of adaptive algorithms such as a least mean square (LMS) algorithm, for example.

The error signal e(n) is input to one whitening filter 15. The whitening filter 15 is configured to whiten (decorrelate) the input error signal e(n), thereby generating an output signal. The signal s(n) is input to the other whitening filter 16. The whitening filter 16 is configured to whiten (decorrelate) the input signal s(n), thereby generating an output signal. Each of the output signals of two whitening filters 15, 16 is supplied to the coefficient updater 14. A main function of the whitening filters 15, 16 is to reduce occurrence of noise by operating the coefficient updater 14 based on the decorrelated signal. Operation of the whitening filters 15, 16 is controlled by the later-described controller 18. The contents of such control will be described later. As illustrated in FIG. 1, a whitening filter coefficient identical to that set for one whitening filter 15 is also set for the other whitening filter 16. Thus, two whitening filters 15, 16 exhibit the same characteristics.

Figure 2:
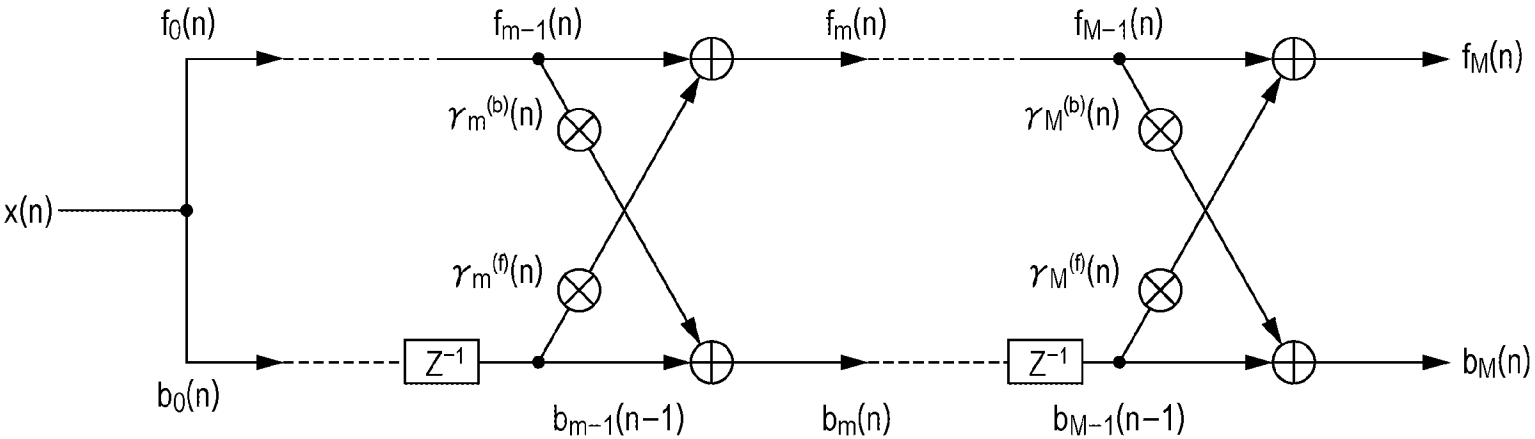
FIG. 2 is a diagram of a configuration example of a M-stage adaptive lattice filter as a whitening filter of FIG. 1.

Specifically, an adaptive lattice filter can be, for example, employed as the whitening filter 15, 16. FIG. 2 illustrates a configuration example of a M-stage adaptive lattice filter. The adaptive lattice filter illustrated in the configuration example of FIG. 2 is configured to sequentially calculate, for each of M stages, forward and backward prediction errors $f_m(n)$, $b_m(n)$ according to the following formulae (1) and (2), with using a reflection coefficient $\gamma_m(n)$, based on an input observation signal x(n):

$$f_m(n)=f_{m-1}(n)+\gamma_m(n)b_{m-1}(n-1) \quad (1)$$

$$b_m(n)=b_{m-1}(n-1)+\gamma_m(n)f_{m-1}(n) \quad (2)$$

where forward and backward reflection coefficients $\gamma_m^{(f)}(n)$, $\gamma_m^{(b)}$ of FIG. 2 are simply represented as the reflection coefficient $\gamma_m(n)$ in the formulae (1) and (2).

Moreover, for the sake of simplicity in description, the reflection coefficient $\gamma_m(n)$ will be hereinafter sometimes simply referred to as a reflection coefficient $\gamma(n)$.

By such calculation using the formulae (1) and (2), a decorrelated signal from which a correlation component contained in the observation signal x(n) has been removed is output from a final stage of the adaptive lattice filter. Note that the whitening filters 15, 16 are not limited to the configuration example of FIG. 2, and a variety of configurations can be employed. Note that in the case of increasing a convergence velocity, the adaptive lattice filter is an effective configuration.

In this embodiment, when the whitening filters 15, 16 are provided only as measures against entrainment, the acoustic feedback component is also whitened at the same time. This leads to insufficient adaptation, and therefore, there are possibilities that an acoustic feedback suppression time is extended. For this reason, in this embodiment, the controller 18 can reliably suppress the acoustic feedback while taking the measures against entrainment by the whitening filters 15, 16. Hereinafter, an example of operation control by the controller 18 will be specifically described with reference to a flowchart of FIG. 3.

Figure 3:
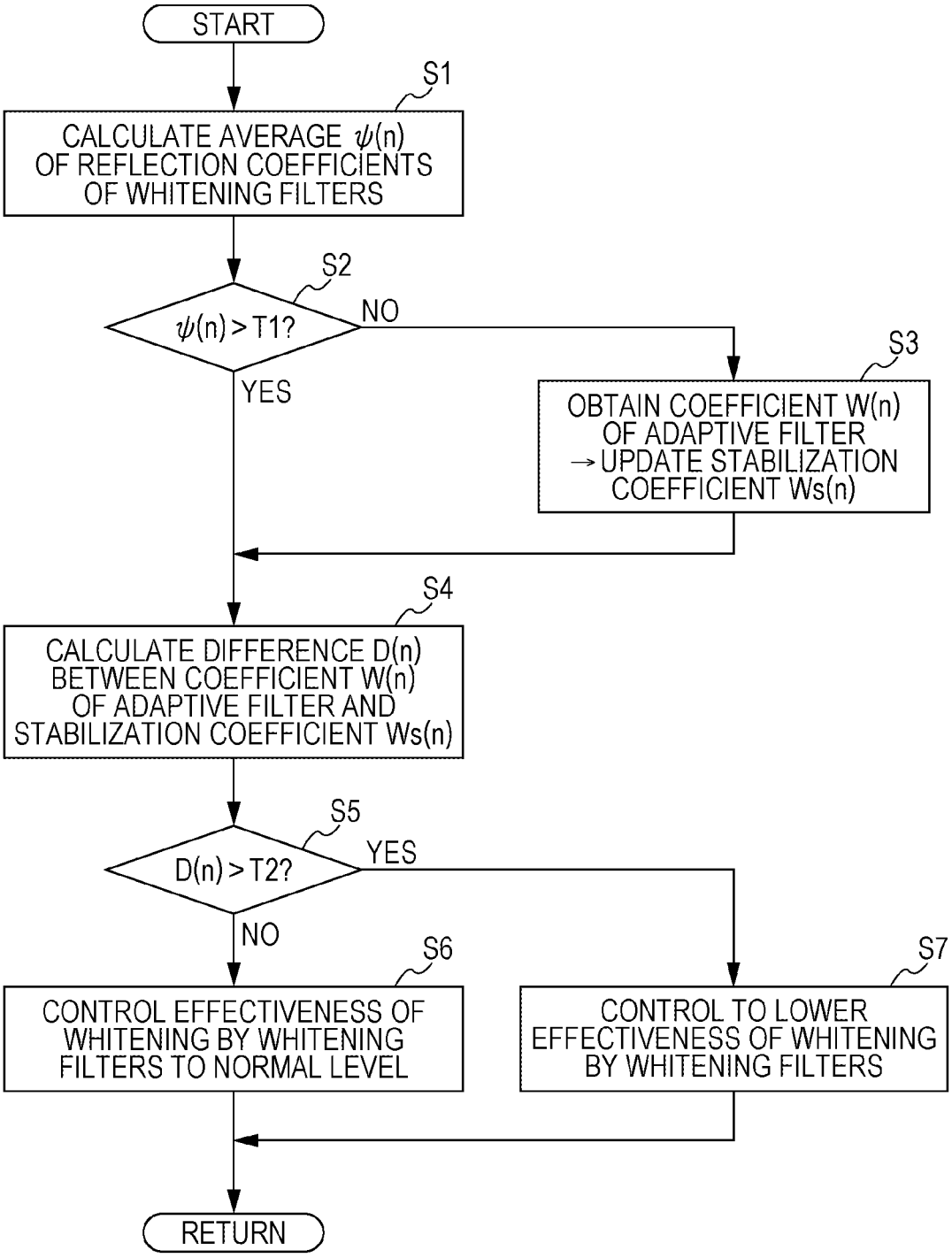
FIG. 3 is a flowchart of an example of operation control by a controller in the hearing aid of this embodiment.

The flowchart of FIG. 3 shows, for example, the flow of processing executed by the controller 18 in every frame (e.g., 1 ms) as a predetermined time interval. When the processing illustrated in FIG. 3 begins, the controller 18 obtains the M-stage reflection coefficients $\gamma(n)$ of the whitening filter 15 at this point, thereby obtaining the sum of these coefficients. Thereafter, the controller 18 calculates the average $\psi(n)$ of the reflection coefficient (a step S1). A case where the whitening filters 15, 16 have the configuration of the adaptive lattice filter illustrated in FIG. 2 will be described herein. In this case, at the step S1, M reflection coefficients $\gamma_0(n)$ to $\gamma_{M-1}(n)$ for a target frame in the configuration of the M-stage adaptive lattice filter of FIG. 2 are obtained.

At the step S1, the average $\psi(n)$ of the reflection coefficient can be calculated according to the following formula (3):

$$\psi(n)=1/M\Sigma|\gamma_m(n)| \quad (3)$$

Figure 4:
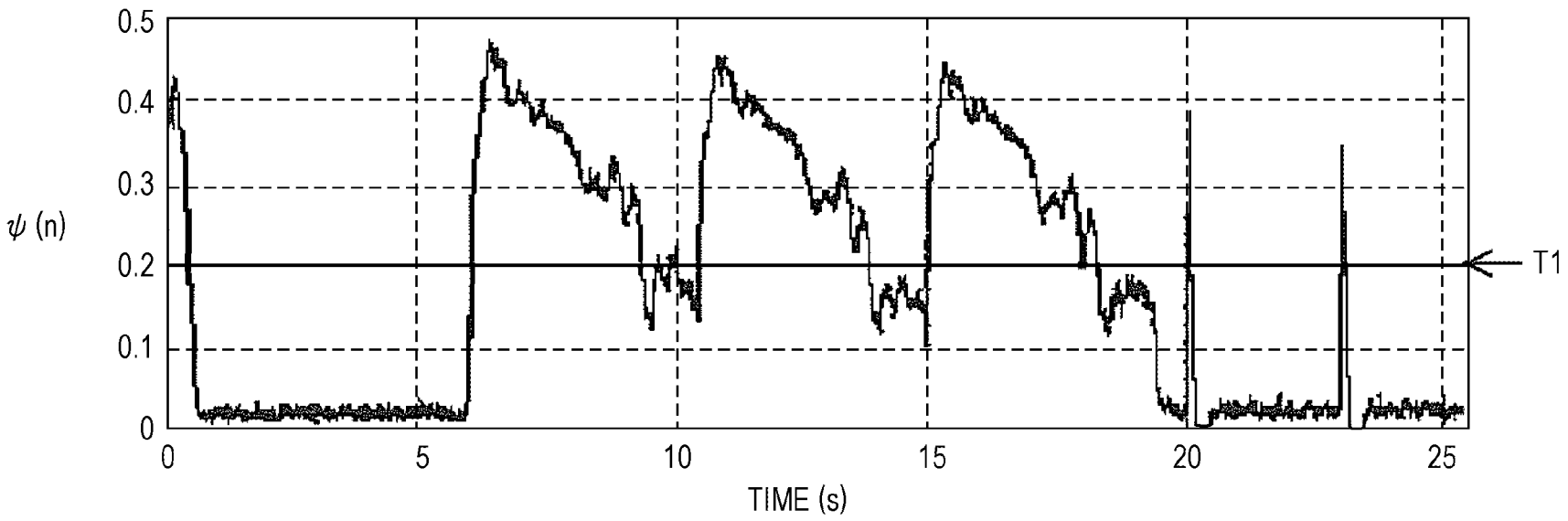
FIG. 4 is a graph of an example of a change in a reflection coefficient average $\psi(n)$ and a threshold T1, the average change and the threshold T1 overlapping with each other in the graph.

Next, the value of the average $\psi(n)$ of the reflection coefficient calculated at the step S1 and the value of a preset threshold T1 (a first threshold of this embodiment) (a step S2) are compared to determine which is larger or smaller. FIG. 4 is a graph of an example of a change in the average $\psi(n)$ of the reflection coefficient and the threshold T1, the average $\psi(n)$ and the threshold T1 overlapping with each other along a time axis in the graph. In the example of FIG. 4, a so-called Buddhist bell (a Buddhist instrument for ringing a bell with a rod) is ringed three times within a range of 25 seconds. Moreover, the M-stage (=16 stages) reflection coefficients $\gamma(n)$ upon input to the whitening filter 15 are extracted. With using the extracted reflection coefficients, the average $\psi(n)$ calculated based on the formula (3) is plotted. That is, FIG. 4 shows a sharp increase and a gradual decrease in the average $\psi(n)$ due to a pure-tone component in three periods of time in which Buddhist bell sound is generated. In this example, Threshold T1=0.2 is set. A magnitude relationship between this value and the average $\psi(n)$ is determined. Note that in FIG. 4, the average $\psi(n)$ temporarily increases even in a period of time in which no Buddhist bell sound is generated. This is because the pure-tone component increases due to, e.g., influence of the acoustic feedback, for example.

As a result of comparison of the step S2, when it is determined that the average $\psi(n)$ is less than the threshold T1 (S2: NO), the coefficient W(n) of the adaptive filter 13 at this point is obtained. Then, a stabilization coefficient Ws(n) saved in a predetermined storage is updated with using the obtained coefficient W(n) of the adaptive filter 13 (a step S3). For example, in FIG. 4, the average $\psi(n)$ falls below the threshold T1 (=0.2) in most of the period of time in which the Buddhist bell sound with a high autocorrelation is not generated. Thus, the step S3 is executed. On the other hand, as a result of comparison of the step S2, when it is determined that the average $\psi(n)$ exceeds the threshold T1 (S2: YES), the step S3 is not executed. For example, in FIG. 4, the average $\psi(n)$ exceeds T1 (=0.2) in three periods of time in which the Buddhist bell sound is generated. Thus, the step S3 is not executed. That is, the stabilization coefficient Ws(n) is the coefficient W(n) of the adaptive filter 13 updated and saved in a stable condition in which a signal with a high autocorrelation, such as the pure-tone component, is not input. Note that in the processing of the steps S1, S2, the average $\psi(n)$ of the reflection coefficient is used. However, the processing of the steps S1, S2 may be performed with using the sum $\Sigma|\gamma_m(n)|$ of the reflection coefficients on the right side of the formula (3) and a threshold adapted thereto.

With using actual environmental sound input to the hearing aid, a desired value is, as the threshold T1 used at the step S2, set in advance based on a condition in which no acoustic feedback occurs and no sound with a high autocorrelation is input. Moreover, in the case where, e.g., a 64-tap adaptive filter 13 is used, all taps are not necessarily saved as the stabilization coefficient Ws(n) updated at the step S3. For example, a coefficient group corresponding to 32 taps, i.e., the first half of 64 taps, can be saved.

In the controller 18, the coefficient W(n) of the adaptive filter at a current point is obtained subsequently after the steps S2, S3. The sum D(n) (hereinafter simply referred to as a "difference D(n)") of a difference for each tap between the coefficient W(n) and the stabilization coefficient Ws(n) updated and saved at the step S3 is calculated (a step S4). In a case where the stabilization coefficient Ws(n) corresponds to 32 taps as described above, the coefficient W(n) obtained at the step S4 may be a coefficient group corresponding to the first half, i.e., 32 taps. At the step S4, the difference for each tap between the corresponding coefficient W(n) at the current point and the stabilization coefficient Ws(n) is added up according to the following formula (4), and in this manner, the difference D(n) is calculated:

$$D(n)=\Sigma|W_s(n)-W(n)| \tag{4}$$

Figure 5A:
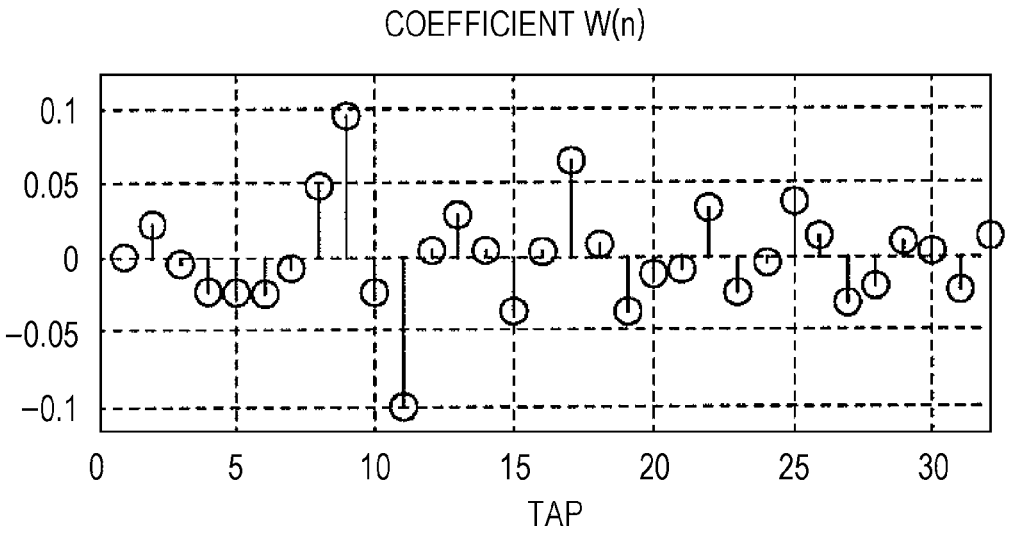
FIGS. 5A and 5B are graphs of numerical value examples of a coefficient W(n) and a stabilization coefficient Ws(n) for 32 taps.
Figure 5B:
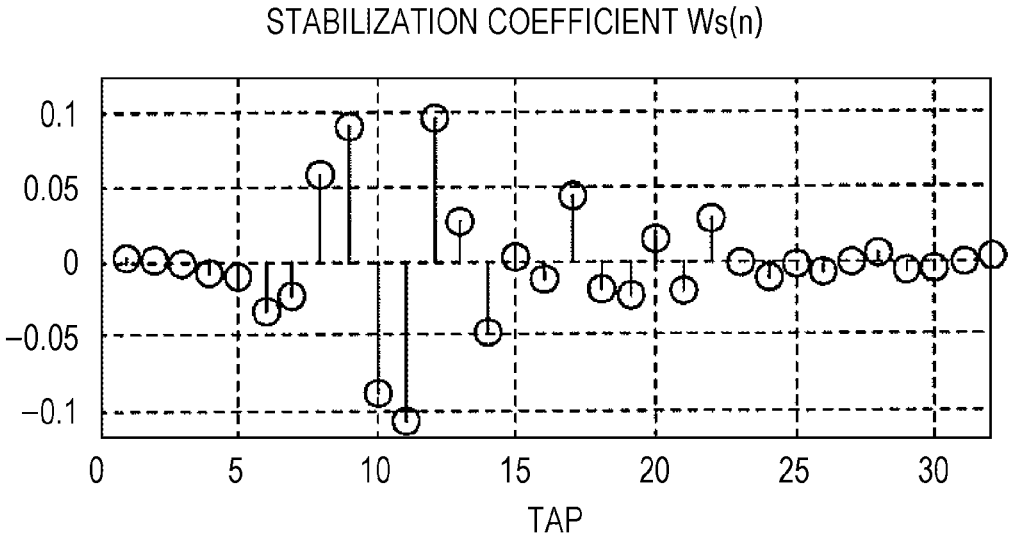
Figure 6A:
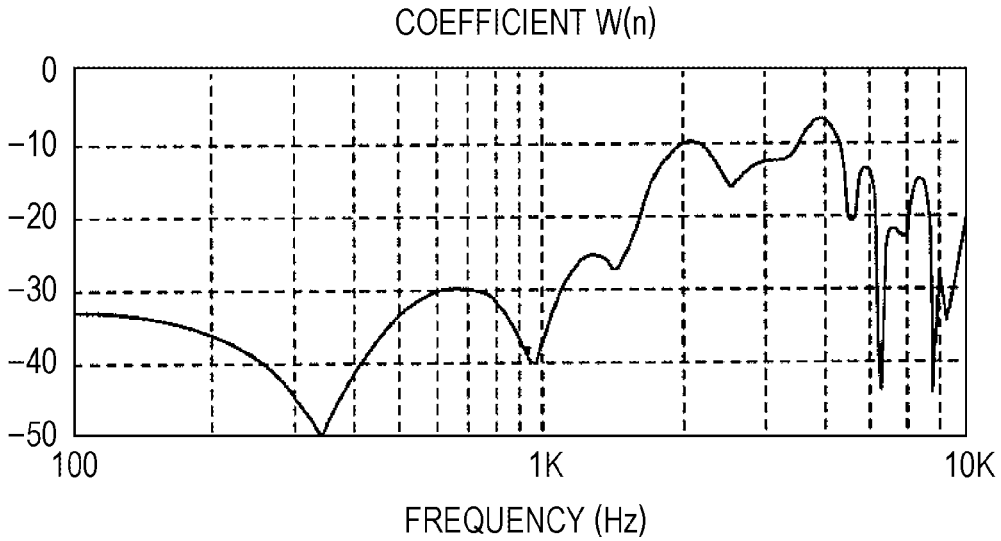
FIGS. 6A and 6B are graphs of frequency characteristics obtained in such a manner that the coefficient W(n) and the stabilization coefficient Ws(n) of FIGS. 5A and 5B are converted into frequencies.
Figure 6B:
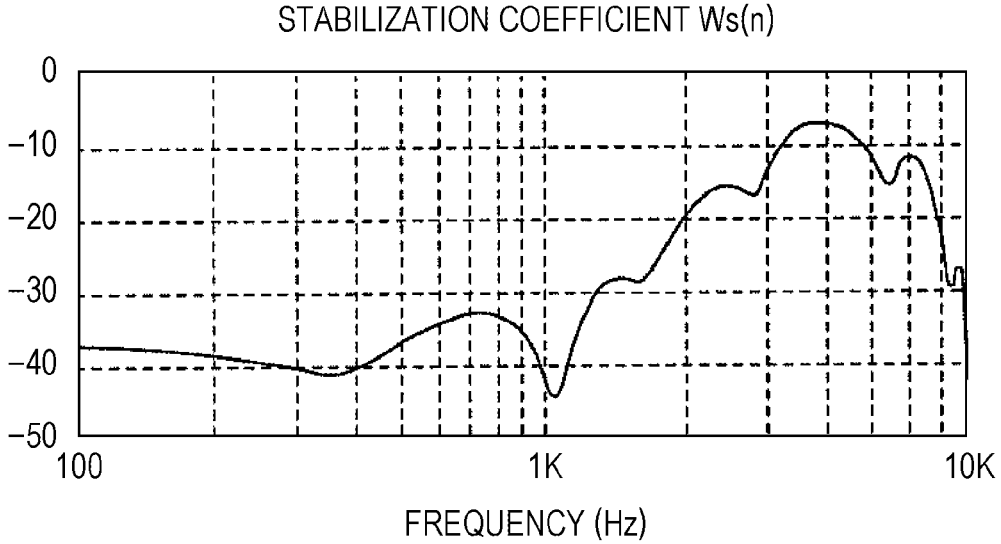

Specific examples of the coefficient W(n) of the adaptive filter 13 and the stabilization coefficient Ws(n) as used at the step S4 will be described herein with reference to FIGS. 5A, 5B, 6A, 6B. FIG. 5A illustrates a numerical value example of the coefficient W(n) for 32 taps. FIG. 5B illustrates a numerical value example of the stabilization coefficient Ws(n) for 32 taps in association with the coefficient W(n) of FIG. 5A. Moreover, FIG. 6A illustrates frequency characteristics obtained in such a manner that the coefficient W(n) of FIG. 5A is converted into a frequency. FIG. 6B illustrates frequency characteristics obtained in such a manner that the stabilization coefficient Ws(n) of FIG. 5B is converted into a frequency. In this example, the coefficient W(n) of FIG. 5A and the stabilization coefficient Ws(n) of FIG. 5B have different values for each tap. This shows a change in the feedback transfer function F(z). According to the degree of change, the difference D(n) becomes a greater value. If the coefficient W(n) and the stabilization coefficient Ws(n) are coincident with each other, Difference D(n)=0 is satisfied. Note that FIG. 3 illustrates an example where the difference D(n) is calculated at S4. Instead of the difference D(n), a desired formula based on a ratio between the coefficient W(n) and the stabilization coefficient Ws(n) can be used for calculation. In this case, similar processing can be applied.

Next, the value of the difference D(n) calculated at the step S4 and the value of a preset threshold T2 (a second threshold of this embodiment) (a step S5) are compared to determine which is larger or smaller. As a result of comparison of the step S5, when it is determined that the value of the difference D(n) is less than the threshold T2 (S5: NO), effectiveness of whitening by the whitening filters 15, 16 is controlled to a normal level (a step S6). On the other hand, as a result of comparison of the step S5, when it is determined that the value of the difference D(n) exceeds the threshold T2 (S5: YES), the effectiveness of whitening by the whitening filters 15, 16 is controlled to a lower level than the normal level (a step S7). Note that as described above, it is assumed that when the effectiveness of whitening by one whitening filter 15 is controlled, the effectiveness of the other whitening filter 16 is also similarly controlled in a moment.

As described above, the presence or absence of a change in the feedback transfer function F(z) is determined at the step S5. That is, in a condition in which the feedback transfer function F(z) does not temporally change, the coefficient W(n) of the adaptive filter 13 shows little change from the stabilization coefficient Ws(n) in the stable condition. Thus, the difference D(n) is a value close to zero. On the other hand, in a condition in which the feedback transfer function F(z) temporally changes due to some kind of factor (e.g., a case where the hand approaches the hearing aid), the coefficient W(n) of the adaptive filter 13 also follows such a change. Thus, the coefficient W(n) of the adaptive filter 13 deviates from the stabilization coefficient Ws(n). As a result, the difference D(n) becomes a greater value. In this embodiment, e.g., Threshold T2=0.002 is set, and a magnitude relationship between this value and the value of the difference D(n) is determined. Note that as in the threshold T1, a desired value is, as the threshold T2, set in advance with using the actual environmental sound input to the hearing aid.

Figure 7:
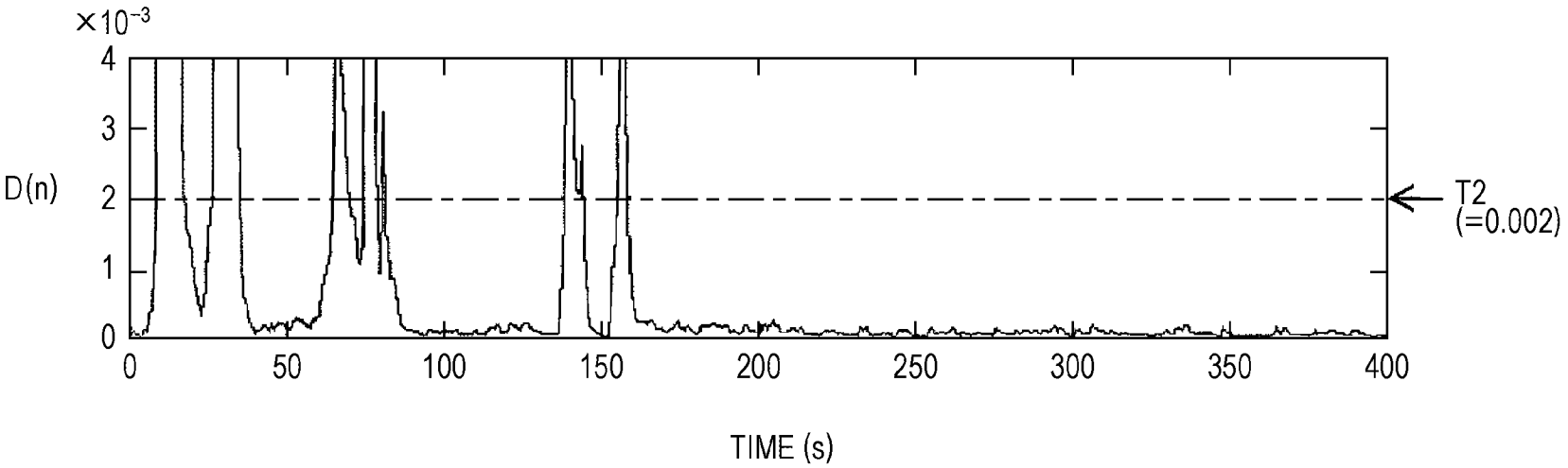
FIG. 7 is a graph of an example of a change in a difference sum D(n) and a threshold T2, the difference sum change and the threshold T2 overlapping with each other in the graph.

FIG. 7 illustrates an example of a change in the value of the difference D(n) and the threshold T2, the difference D(n) and the threshold T2 overlapping with each other along a time axis in the graph. In the example of FIG. 7, the value of the difference D(n) calculated according to the formula (4) fluctuates according to environmental sound input within a predetermined time. In a period of time in which the value of the difference D(n) falls below the threshold T2 (=0.002), the feedback transfer function F(z) can be regarded as unchanged. In other periods of time, the feedback transfer function F(z) can be regarded as changed. Note that for the sake of illustration in FIG. 7, the difference D(n) is illustrated within a range up to the upper limit (0.004) of the vertical axis. Note that in fact, there is a period of time in which the difference D(n) greatly exceeds the upper limit.

A variety of methods is applicable to the control of the effectiveness of whitening by the whitening filter 15 at the steps S6, S7. However, for example, in the case of updating the reflection coefficient $\gamma_m(n)$ based on the following formulae (5), (6), and (7), $0<\lambda1<\lambda2<1$ is set, and in this manner, the effectiveness of whitening can be reduced. Moreover, $\lambda1=\lambda2$ is set, and in this manner, the maximum effectiveness of whitening can be obtained. In this case, when the determination is NO at the step S5 and the processing proceeds to the step S6, in that situation, no acoustic feedback occurs. Thus, there is no problem even when the effectiveness of whitening by the whitening filter 15 remains high. For occurrence of entrainment, the effect is fulfilled. On the other hand, when the determination is YES at the step S5 and the processing proceeds to the step S7, there are high possibilities that the acoustic feedback occurs. At this point, whitening by the whitening filter 15 influences adaptive operation of the adaptive filter 13. For this reason, the control to temporarily reduce the effectiveness of whitening by the whitening filter 15 is necessary. For the steps S6, S7, a case where there are two levels of the effectiveness of whitening has been described. Note that the number of the stages may be increased. In this case, the effectiveness level can be set as necessary.

$$\gamma_m=n_m(n)/d_m(n) \tag{5}$$

$$d_m(n)=\lambda_2 d_m(n-1)+(1-\lambda_2)f^2_{m-1}(n)b^2_{m-1}(n-1) \tag{6}$$

$$n_m(n)=\lambda_1 n_m(n-1)+(1-\lambda_1)(-2)f_{m-1}(n)b_{m-1}(n-1) \tag{7}$$

Note that although not shown in the flowchart of FIG. 3, control of the convergence velocity of the adaptive filter 13 may be added as processing subsequent to the steps S6, S7. Specifically, when it is, at the step S5, determined that the feedback transfer function F(z) does not change (S5: YES), the control to increase a step size as a parameter regarding the convergence velocity of the adaptive filter 13 than that in a normal mode is performed subsequent to the step S7. This allows convergence of the adaptive filter 13 within a short period of time in a situation where the acoustic feedback has occurred. Note that after this processing, when it is, at the step S5, determined that the feedback transfer function F(z) has changed (the step S5: NO), the control to return the adaptive filter 13 to the normal step size is necessary subsequent to the step S6.

Figure 8:
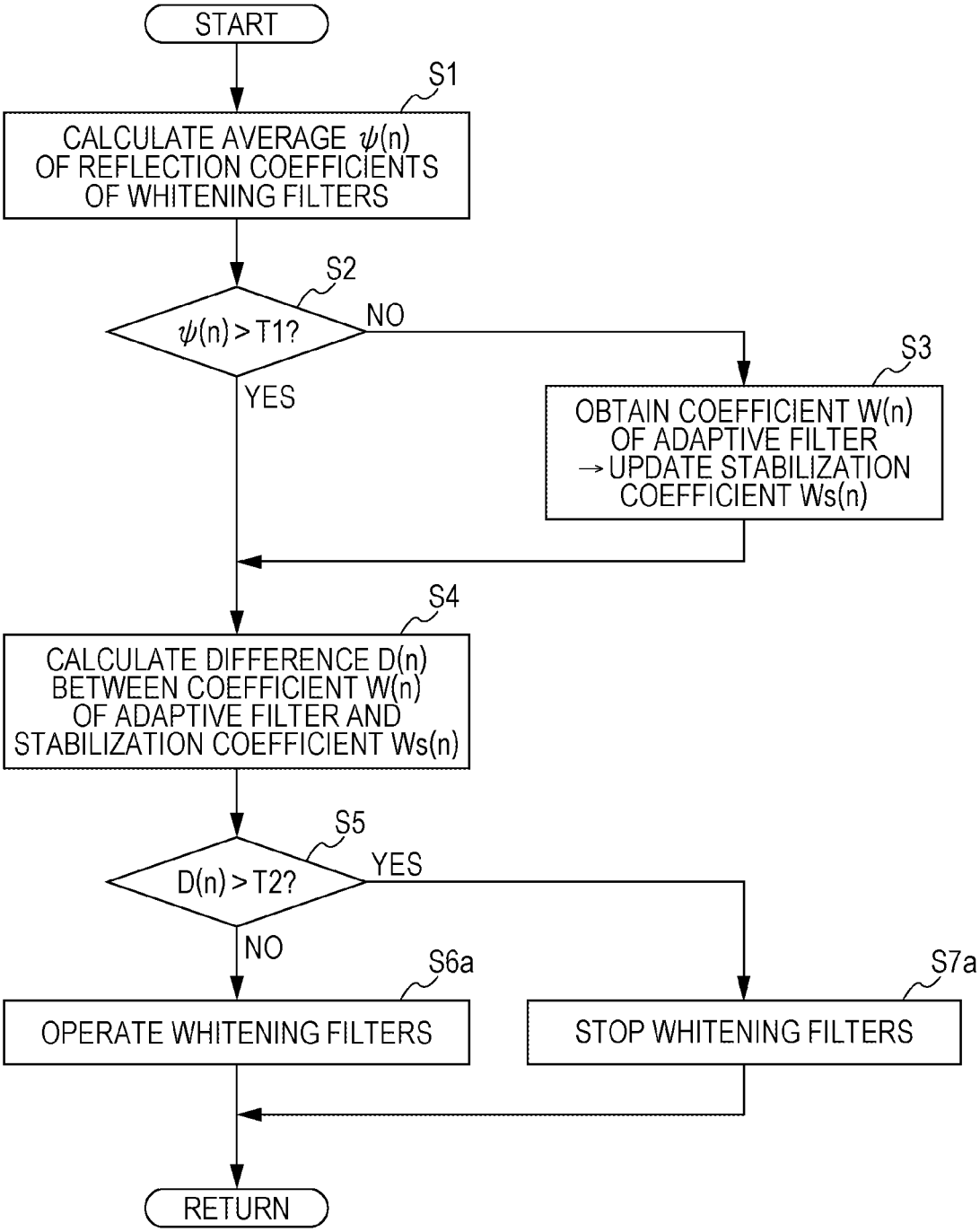
FIG. 8 illustrates a variation in which processing of steps S6, S7 of the flowchart of FIG. 3 is changed.

The flowchart of FIG. 3 is one example of this embodiment. For this embodiment, a variety of change is available. FIG. 8 illustrates a variation in which the processing of the steps S6, S7 of the flowchart of FIG. 3 is changed. That is, in the variation of FIG. 8, the processing of controlling operation conditions of the whitening filters 15, 16 is performed as steps S6*a*, S6*b* instead of the processing of controlling the effectiveness of whitening at the steps S6, S7 of FIG. 3. Specifically, when it is determined that the feedback transfer function F(z) does not change, the whitening filters 15, 16 are actuated at the step S6*a*. When it is determined that the feedback transfer function F(z) has changed, operation of the whitening filters 15, 16 is stopped at the step S7*a*.

Even when the control according to the variation illustrated in FIG. 8 is applied, if the acoustic feedback occurs, an adverse effect on the adaptive operation of the adaptive filter 13 can be avoided through the steps S5, S7*a* as illustrated in FIG. 3. As compared to the control illustrated in FIG. 3, the operation condition is, in the control illustrated in FIG. 8, instantly switched in association with switching of ON/OFF of the whitening filters 15, 16. Thus, it is to be desired that the control of FIG. 3 is applied for avoiding malfunction. Note that, in the case of stopping operation of the whitening filters 15, 16 at the step S7*a* of FIG. 8, this case can be handled in such a manner that a signal path is changed in order that the error signal e(n) and the signal s(n) are directly input to the coefficient updater 14 in FIG. 1, for example.

Figure 9:
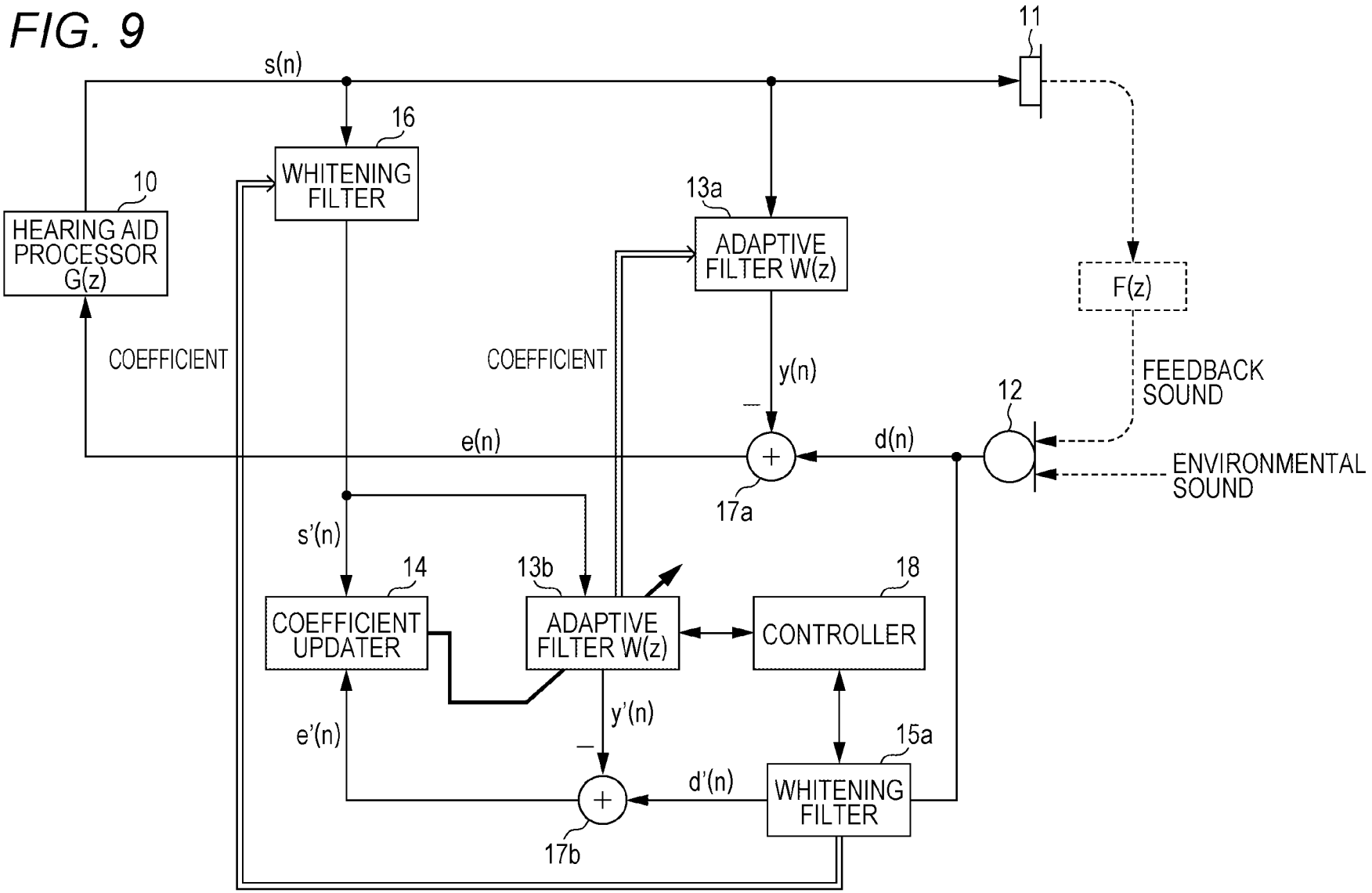
FIG. 9 is a block diagram of one variation of the configuration example of FIG. 1 in the hearing aid of this embodiment.

In the case of forming the hearing aid of this embodiment, this disclosure is not limited to the configuration example of FIG. 1, and a variety of modifications can be made. FIG. 9 is a block diagram of one variation of the configuration example of FIG. 1 in the hearing aid of this embodiment. The variation of FIG. 9 is different from FIG. 1 in a connection form. The hearing aid processor 10, the receiver 11, the microphone 12, two of the adaptive filters 13*a*, 13*b*, the coefficient updater 14, the whitening filters 15*a*, 16, two of the subtractors 17*a*, 17*b*, and the controller 18 are illustrated. Unlike FIG. 1, the output-side configuration of the microphone 12 is branched into two systems in this variation.

That is, the desired signal d(n) is converted into a desired signal d'(n) via a whitening filter 15*a*. The subtractor 17*b* subtracts an output signal y'(n) of the adaptive filter 13*b* from the desired signal d'(n). A signal obtained by subtraction is, as an error signal e'(n), output from the subtractor 17*b*. The coefficient updater 14 updates, based on the error signal e'(n) and a signal s'(n) output from the whitening filter 16, the coefficient W(n) used for data processing in the adaptive filter 13*b*. In FIG. 9, a whitening filter coefficient identical to that set for one whitening filter 15*a* is also set for the other whitening filter 16. In addition, a coefficient W(n) identical to that set for one adaptive filter 13*b* is also set for the other adaptive filter 13*a*.

Moreover, the controller 18 illustrated in FIG. 9 controls, according to processing similar to that of FIG. 3, operation of the whitening filter 15*a* and the adaptive filter 13*b*. As described above, even in the case of employing the variation of FIG. 9 instead of the configuration of FIG. 1, the features and the advantageous effects described in this embodiment can be obtained.

As described above, according to the hearing aid of this embodiment, the presence or absence of a temporal change in the feedback transfer function F(z) is determined at the steps S4, S5. According to such a determination result, operation of the whitening filters 15, 16 can be properly controlled. When the control illustrated in FIG. 3 is not performed, if the feedback transfer function F(z) rapidly changes due to the acoustic feedback, operation of the whitening filters 15, 16 provides an adverse effect to the adaptive operation of the adaptive filter 13. However, in this embodiment, the effectiveness of whitening by the whitening filters 15, 16 is temporarily reduced in such a situation. With this configuration, the adaptive operation of the adaptive filter 13 can be stabilized, and the acoustic feedback can be reliably suppressed. Moreover, the presence or absence of a change in the feedback transfer function F(z) is determined with using the stabilization coefficient Ws(n) updated and saved in the stable condition at the steps S2, S3. Thus, erroneous determination upon input of a signal with a high autocorrelation can be effectively prevented. Moreover, in this embodiment, the whitening filters 15, 16 are provided as the measures against entrainment. Thus, this embodiment has an advantage in terms of obtaining favorable sound quality as compared to, e.g., a frequency shift method.

In the above-described embodiment, the case where the technique of this disclosure is applied to the hearing aid has been described. Note that the technique of this disclosure is not limited to above, and is applicable to feedback cancellers in a variety of equipment. For example, the technique of this disclosure is applicable to an echo canceller (a conferencing system). As long as the feedback canceller according to this disclosure at least has the function of determining the presence or absence of a change in the feedback transfer function F(z) as in the steps S4, S5 illustrated in FIG. 3, the feedback canceller is applicable to the equipment and system for performing a variety of control according to the determination result.

The hearing aid of this disclosure may be the following first to seventh hearing aids.

The first hearing aid includes a receiver configured to convert an electric signal into sound; a microphone configured to convert sound into an electric signal; an adaptive filter configured to adaptively estimate a feedback transfer function from the receiver to the microphone; a subtractor configured to subtract an output signal of the adaptive filter from an output signal of the microphone, thereby generating a first signal; a hearing aid processor configured to perform predetermined hearing aid processing for the first signal, thereby generating a second signal to be input to the receiver; a first whitening filter configured to whiten the first signal; a second whitening filter configured to whiten the second signal with using a whitening filter coefficient identical to that of the first whitening filter; a coefficient updater configured to update the coefficient of the adaptive filter based on each of output signals of the first and second whitening filters; and a controller configured to control operation of the adaptive filter and the first and second whitening filters. The controller updates and saves, as a stabilization coefficient, the coefficient of the adaptive filter in a condition in which the autocorrelation of the first signal is low, determines the presence or absence of a change in the feedback transfer function based on the coefficient of the adaptive filter and the stabilization coefficient, and when it is determined that the feedback transfer function has changed, controls the effectiveness of whitening by the first and second whitening filters to be reduced as compared to that when it is determined that the feedback transfer function does not change.

The second hearing aid is the first hearing aid in which the controller calculates the average of the whitening filter coefficients and updates the stabilization coefficient when it is, as a result of comparison between a preset first threshold and the average, determined that the average is smaller.

The third hearing aid is the first hearing aid in which, when it is determined that the feedback transfer function does not change, the controller controls the effectiveness of whitening to be at a predetermined level, and when it is determined that the feedback transfer function has changed, the controller performs the control in order that the effectiveness of whitening is lower than the predetermined level.

The fourth hearing aid is the first hearing aid in which when it is determined that the feedback transfer function does not change, the controller actuates the whitening filters, and when it is determined that the feedback transfer function has changed, the controller stops operation of the whitening filters.

The fifth hearing aid is the first or second hearing aid in which each of the whitening filters is an adaptive lattice filter with a predetermined number of stages, and each of the whitening filter coefficients is the reflection coefficient of the adaptive lattice filter.

The sixth hearing aid is the fourth or fifth hearing aid in which the controller calculates the sum of a difference between the coefficient of the adaptive filter and the stabilization coefficient and compares a preset second threshold with the difference sum to determine, according to a comparison result, the presence or absence of a change in the feedback transfer function.

The seventh hearing aid is the first hearing aid in which when it is determined that the feedback transfer function has changed, the controller performs the control to increase the convergence velocity of the adaptive filter in addition to the control to reduce the effectiveness of whitening by the whitening filters.

The feedback canceller of this disclosure may be the following first to second feedback cancellers.

The first feedback canceller includes a first conversion device configured to convert an electric signal into sound; a second conversion device configured to convert sound into an electric signal; an adaptive filter configured to adaptively estimate a feedback transfer function from the first conversion device to the second conversion device; a subtractor configured to subtract an output signal of the adaptive filter from an output signal of the second conversion device, thereby generating a first signal; a signal processor configured to perform predetermined signal processing for the first signal, thereby generating a second signal to be input to the first conversion device; a coefficient updater configured to update the coefficient of the adaptive filter; and a controller configured to at least control operation of the adaptive filter. The controller updates and saves, as a stabilization coefficient, the coefficient of the adaptive filter in a condition in which the autocorrelation of the first signal is low, and determines the presence or absence of a change in the feedback transfer function based on the coefficient of the adaptive filter and the stabilization coefficient.

The second feedback canceller is the first feedback canceller further including a first whitening filter configured to whiten the first signal and a second whitening filter configured to whiten the second signal with using having a whitening filter coefficient identical to that of the first whitening filter. The coefficient updater updates the coefficient of the adaptive filter based on each of output signals of the first and second whitening filters. When it is determined that the feedback transfer function has changed, the controller controls the effectiveness of whitening by the first and second whitening filters to be reduced as compared to that when it is determined that the feedback transfer function does not change.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A hearing aid comprising:

a receiver configured to convert an electric signal into sound;

a microphone configured to convert sound into an electric signal;

an adaptive filter configured to adaptively estimate a feedback transfer function from the receiver to the microphone;

a subtractor configured to subtract an output signal of the adaptive filter from an output signal of the microphone, thereby generating a first signal;

a hearing aid processor configured to perform predetermined hearing aid processing for the first signal, thereby generating a second signal to be input to the receiver;

a first whitening filter configured to whiten the first signal;

a second whitening filter having a whitening filter coefficient identical to that of the first whitening filter and configured to whiten the second signal;

a coefficient updater configured to update a coefficient of the adaptive filter based on each of output signals of the first and second whitening filters; and a controller configured to perform control of operation of the adaptive filter and the first and second whitening filters, wherein the controller updates and saves a stabilization coefficient which is the coefficient of the adaptive filter obtained at a point of time in which an autocorrelation of the first signal is low, obtains the coefficient of the adaptive filter, determines a presence or absence of a change in the feedback transfer function based on a difference or a ratio between the obtained coefficient of the adaptive filter and the stabilization coefficient, and performs, when it is determined that the feedback transfer function has changed, the control in order that effectiveness of whitening by the first and second whitening filters is reduced as compared to that when it is determined that the feedback transfer function does not change.

2. The hearing aid according to claim 1, wherein each of the first and second whitening filters is an adaptive lattice filter with M number of stages, the adaptive lattice filter of each of the first and second whitening filters has M stage reflection coefficients, and the controller calculates an average of the M-stage reflection coefficients of either one of the first whitening filter or the second whitening filter, and updates the stabilization coefficient when it is, as a result of comparison between a preset first threshold and the average, determined that the average is smaller.

3. The hearing aid according to claim 1, wherein when it is determined that the feedback transfer function does not change, the controller performs the control in order that the effectiveness of whitening is at a predetermined level, and when it is determined that the feedback transfer function has changed, the controller performs the control in order that the effectiveness of whitening is lower than the predetermined level.

4. The hearing aid according to claim 1, wherein when it is determined that the feedback transfer function does not change, the controller actuates the whitening filters, and when it is determined that the feedback transfer function has changed, the controller stops operation of the whitening filters.

5. The hearing aid according to claim 1, wherein each of the whitening filters is an adaptive lattice filter with a predetermined number of stages, and each of the whitening filter coefficients is a reflection coefficient of the adaptive lattice filter.

6. The hearing aid according to claim 4, wherein the controller calculates a sum of differences, each of the differences being a difference between the obtained coefficient of the adaptive filter and the stabilization coefficient, and compares a preset second threshold with the sum of the differences to determine, according to a comparison result, the presence or absence of the change in the feedback transfer function.

7. The hearing aid according to claim 5, wherein the controller calculates a sum of differences, each of the differences being a difference between the obtained coefficient of the adaptive filter and the stabilization coefficient, and compares a preset second threshold with the sum of the differences to determine, according to a comparison result, the presence or absence of the change in the feedback transfer function.

8. The hearing aid according to claim 1, wherein when it is determined that the feedback transfer function has changed, the controller performs control to increase a convergence velocity of the adaptive filter in addition to the control to reduce the effectiveness of whitening by the whitening filters.

9. A feedback canceller comprising:

a first conversion device configured to convert an electric signal into sound;

a second conversion device configured to convert sound into an electric signal;

an adaptive filter configured to adaptively estimate a feedback transfer function from the first conversion device to the second conversion device;

a subtractor configured to subtract an output signal of the adaptive filter from an output signal of the second conversion device, thereby generating a first signal;

a signal processor configured to perform predetermined signal processing for the first signal, thereby generating a second signal to be input to the first conversion device;

a coefficient updater configured to update a coefficient of the adaptive filter; and a controller configured to perform at least control of operation of the adaptive filter, wherein the controller updates and saves a stabilization coefficient which is the coefficient of the adaptive filter obtained at a point of time in which an autocorrelation of the first signal is low, obtains the coefficient of the adaptive filter, and determines a presence or absence of a change in the feedback transfer function based on a difference or a ratio between the obtained coefficient of the adaptive filter and the stabilization coefficient.

10. The feedback canceller according to claim 9, further comprising:

a first whitening filter configured to whiten the first signal; and a second whitening filter having a whitening filter coefficient identical to that of the first whitening filter and configured to whiten the second signal, wherein the coefficient updater updates the coefficient of the adaptive filter based on each of output signals of the first and second whitening filters, and when it is determined that the feedback transfer function has changed, the controller performs the control in order that effectiveness of whitening by the first and second whitening filters is reduced as compared to that when it is determined that the feedback transfer function does not change.

* * * * *